US006928932B1

(12) United States Patent
Ferrill

(10) Patent No.: US 6,928,932 B1
(45) Date of Patent: Aug. 16, 2005

(54) JIGSAW PUZZLE HOLDING AND ASSEMBLING TABLE

(76) Inventor: Trent A. Ferrill, 111 Greendell La., Highlands, TX (US) 77562

( * ) Notice: Subject to any disclaimer, the term of this patent is extended or adjusted under 35 U.S.C. 154(b) by 194 days.

(21) Appl. No.: 10/361,965

(22) Filed: Feb. 12, 2003

(51) Int. Cl.[7] ..... A47B 85/00
(52) U.S. Cl. ..... 108/23; 108/26
(58) Field of Search ..... 108/23, 25, 26, 108/43, 1; 248/441.1, 444, 454

(56) References Cited

U.S. PATENT DOCUMENTS

| | | | | | |
|---|---|---|---|---|---|
| 647,807 | A | * | 4/1900 | Collins | 108/43 |
| 3,123,935 | A | * | 3/1964 | Williams | 108/43 |
| 3,884,478 | A | | 5/1975 | Sanders | |
| 4,312,507 | A | * | 1/1982 | Smith et al. | 108/23 |
| 4,404,915 | A | * | 9/1983 | Simpson | 108/43 |
| 4,484,745 | A | | 11/1984 | Sleeper | |
| 4,645,163 | A | * | 2/1987 | Zovar | 108/1 |
| 4,700,634 | A | * | 10/1987 | Mills et al. | 108/43 |
| 4,718,630 | A | * | 1/1988 | Richard | 108/1 |
| 4,865,325 | A | | 9/1989 | Stolz | |
| 5,692,815 | A | * | 12/1997 | Murphy | 108/43 |
| 5,788,575 | A | * | 8/1998 | Fluster | 108/43 |
| 5,979,337 | A | * | 11/1999 | Clark et al. | 108/43 |

FOREIGN PATENT DOCUMENTS

| | | | | |
|---|---|---|---|---|
| DE | 3939216 | A1 * | 6/1990 | A47B 37/00 |

* cited by examiner

*Primary Examiner*—Jose V. Chen

(57) ABSTRACT

A jigsaw puzzle holding and assembling table includes a panel having an upper surface and a lower surface. The panel has a perimeter edge including a front edge, a back edge, a first side edge and a second side edge. Each of a pair of supports is releasably insertable into one of a pair of holes extending into the bottom surface. Each of the holes is adjacent to the back edge. A drawer assembly is mounted on the bottom surface.

8 Claims, 3 Drawing Sheets

JIGSAW PUZZLE HOLDING AND ASSEMBLING TABLE

BACKGROUND OF THE INVENTION

1. Field of the Invention

The present invention relates to game tables and more particularly pertains to a new game table for providing a user with a convenient means to work on a puzzle while using a minimum amount of table space.

2. Description of the Prior Art

The use of game tables is known in the prior art. U.S. Pat. No. 3,884,476 describes a puzzle table designed for working out puzzles thereupon which are of a type wherein colors must be clearly distinguished. Another type of game table is U.S. Pat. No. 4,484,745 describes a jigsaw puzzle assembly and storage apparatus that utilizes a flexible magnetic cover for holding puzzle pieces in place. U.S. Pat. No. 4,865,325 describes a jigsaw puzzle support and storage board.

While these devices fulfill their respective, particular objectives and requirements, the need remains for a device allows a user to efficiently assemble puzzles.

SUMMARY OF THE INVENTION

The present invention meets the needs presented above by utilizing a plurality of supports to elevate the panel so the user may sit in front of the device while still having access to a drawer located on the side of the unit.

Another object of the present invention is to provide a new game table that would eliminate the need to stand up or learn forward to reach all areas of the puzzle.

Still another object of the present invention is to provide a new game table that would allow the puzzle to be moved when necessary and would store unassembled pieces in the drawer, thereby preventing loss of the puzzle pieces.

To this end, the present invention generally comprises a panel having an upper surface and a lower surface. The panel has a perimeter edge including a front edge, a back edge, a first side edge and a second side edge. Each of a pair of supports is releasably insertable into one of a pair of holes extending into the bottom surface. Each of the holes is adjacent to the back edge. A drawer assembly is mounted on the bottom surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
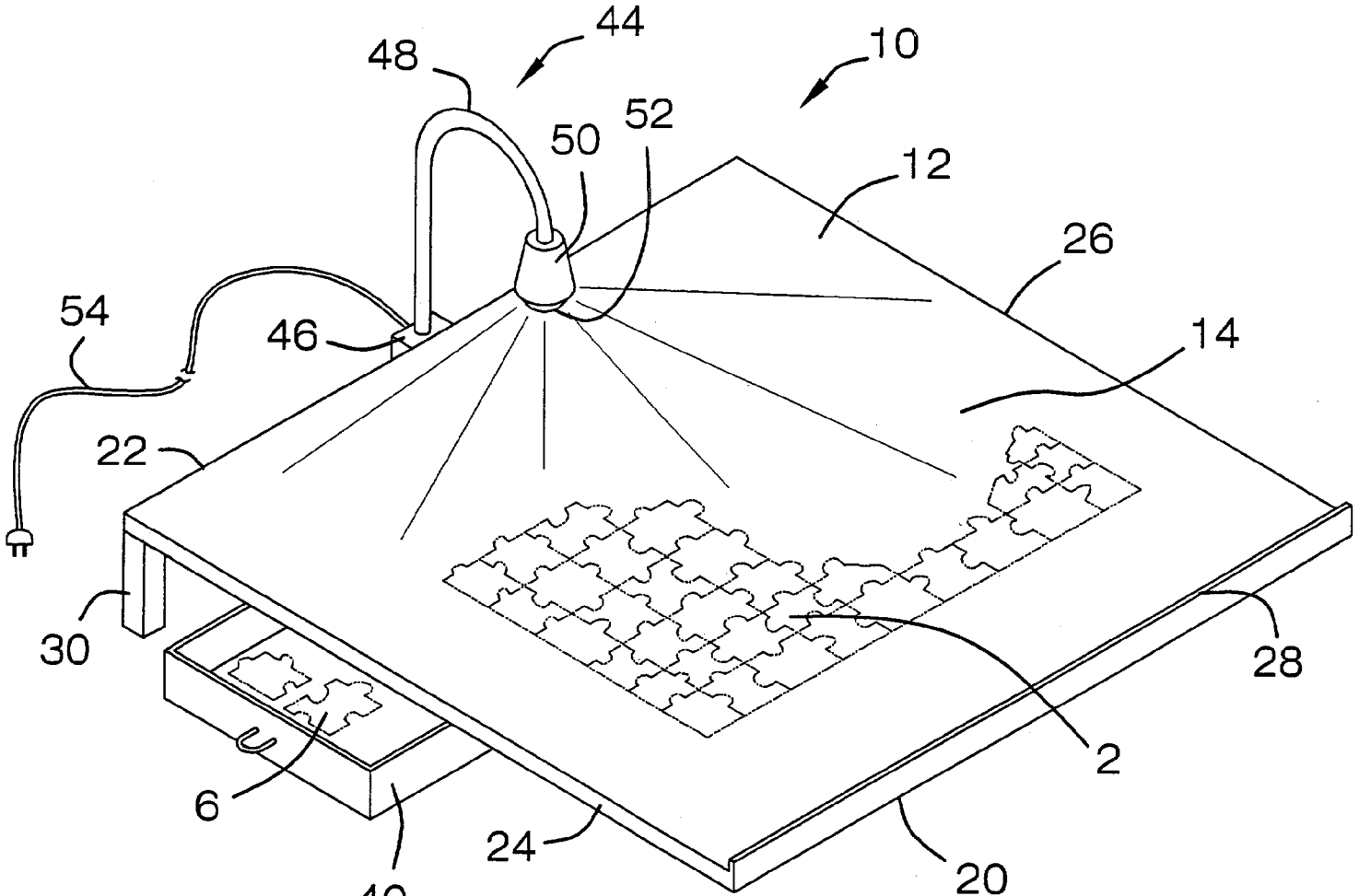
FIG. 1 is a perspective view of a jigsaw puzzle holding and assembling table according to the present invention.
Figure 2:
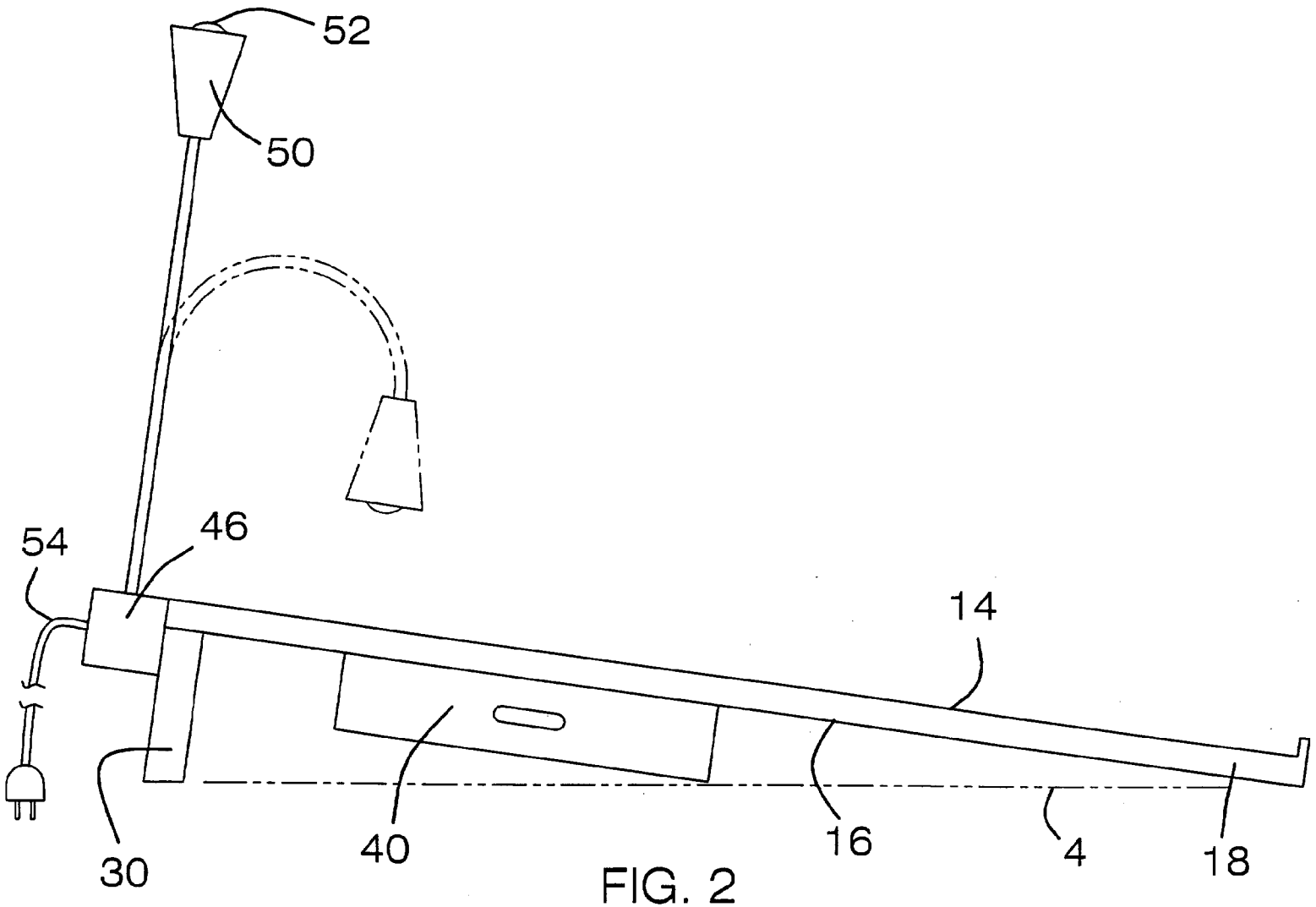
FIG. 2 is a side view of the present invention.
Figure 3:
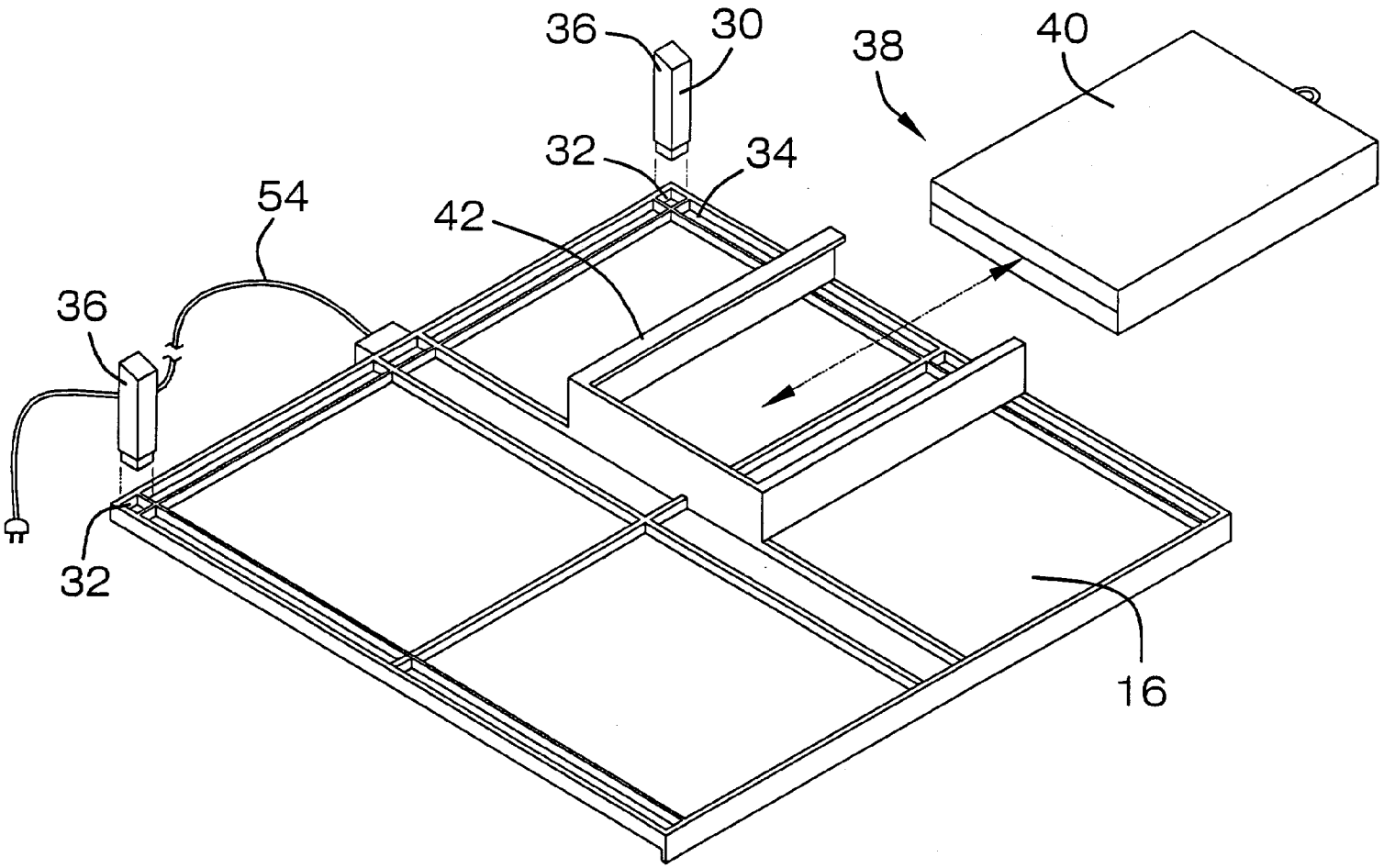
FIG. 3 is a bottom perspective view of the present invention.

With reference now to the drawings, and in particular to FIGS. 1 through 3 thereof, a new game table embodying the principles and concepts of the present invention and generally designated by the reference numeral 10 will be described.

As best illustrated in FIGS. 1 through 3, the jigsaw puzzle holding and assembling table 10 generally comprises 10 a panel 12 having an upper surface 14 and a lower surface 16. The panel 12 has a perimeter edge 18 including a front edge 20, a back edge 22, a first side edge 24 and a second side edge 26. A lip 28 is attached to and extends along the front edge 20. The lip 28 extends upward to hold a puzzle 2 as it placed on the panel 12 and the panel 12 is angled downward toward the lip 28.

Each of a pair of supports 30 is releasably insertable into one of a pair of holes 32 extending into the bottom surface 34. The holes 32 each are positioned adjacent to the back edge 22 and one of the first 24 and second 26 side edges. The supports 30, when positioned in the holes 32, support the panel 12 in an angled orientation with respect to a ground surface 4 as shown in FIG. 2. The legs 36 are preferably removable so that they may be stored along with puzzle pieces 6.

A drawer assembly 38 is mounted on the bottom surface 34. The drawer assembly 38 is positioned such that a drawer 40 of the drawer assembly 38 is extendable outwardly away from the first side edge 24, or, alternatively, the second side edge 26. The drawer assembly 38 is positioned nearer the back edge 22 than the front edge 20. The supports 30 have a height such that the drawer assembly 38 is displaced away from the ground surface 4 when the panel 12 is supported by the front edge 20 and the supports 30. This allows the drawer 40 to be removed from a support railing 42 while the device is positioned on the ground surface 4 without the drawer 40 striking the ground surface 4. Also, by being positioned along a side edge of the panel 12, the drawer 40 is accessible by a child sitting by the front edge 20.

A light emitting device 44 is mounted on the panel 12. The light emitting device 44 is adapted for selectively directing light emitted from the light emitting device 44 anywhere on the panel 12. The light emitting device 44 includes a base 46, a neck 48 and a head portion 50. The base 46 is attached to the back edge 22. The neck 48 is attached to and extends upwardly from the base 46. The neck 48 is selectively bendable. The head portion 50 is attached to an upper end of the neck 48. The head portion 50 is adapted for receiving a light bulb 52. The neck 48 is bendable so that the head portion 50 can be directed anywhere on the board, or even into the drawer 40 for illuminating jigsaw pieces 6 on the board or in the drawer 40. A power supply for the light emitting device 44 preferably included an electrical cord 54.

In use, puzzle pieces 6 are stored in the drawer 40 and the puzzle 2 assembled on the upper surface of the panel. The light aids in seeing the puzzle pieces and the supports may be stored in the drawer 40 for easy storage of the device.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A jigsaw puzzle support and storage device, said device comprising:

a panel having an upper surface and a lower surface, said panel having a perimeter edge including a front edge, a back edge, a first side edge and a second side edge;

a pair of supports, each of said supports being releasably insertable into one of a pair of holes extending into said bottom surface, each of said holes being adjacent to said back edge, said supports supporting said panel on a surface and in an angled orientation with respect to the surface, each of said supports comprising a leg extending downwardly from said panel;

a drawer assembly being mounted on said bottom surface, said drawer assembly is positioned such that a drawer of said drawer assembly is extendable outwardly away from said first side edge; and a lip being attached to and extending along said front edge, said lip extending upward.

2. The jigsaw puzzle support and storage device of claim 1, wherein each of said holes is adjacent to one of said first and second side edges.

3. The jigsaw puzzle support and storage device of claim 1, wherein said drawer assembly is positioned nearer said back edge than said front edge.

4. The jigsaw puzzle support and storage device of claim 1, wherein said supports have a height such that said drawer assembly is displaced away from the surface when said panel is supported by said front edge and said supports.

5. The jigsaw puzzle support and storage device of claim 1, further including a light emitting device being mounted on said panel.

6. The jigsaw puzzle support and storage device of claim 5, wherein said light emitting device is adapted for selectively directing light emitted from said light emitting device.

7. The jigsaw puzzle support and storage device of claim 6, wherein said light emitting device includes a base, a neck and a head portion, said base being attached to said panel, said neck being attached to and extending upwardly from said base, said neck being selectively bendable, said head portion being attached to an upper end of said neck, said head portion being adapted for receiving a light bulb.

8. A jigsaw puzzle support and storage device, said device comprising:

a panel having an upper surface and a lower surface, said panel having a perimeter edge including a front edge, a back edge, a first side edge and a second side edge, a lip being attached to and extending along said front edge, said lip extending upward;

a pair of supports, each of said supports being releasably insertable into one of a pair of holes extending into said bottom surface, each of said holes being adjacent to said back edge and one of said first and second side edges, said supports supporting said panel on a surface and in an angled orientation with respect to the surface, each of said supports comprising a leg extending downwardly from said panel;

a drawer assembly being mounted on said bottom surface, said drawer assembly being positioned such that a drawer of said drawer assembly is extendable outwardly away from said first side edge, said drawer assembly being positioned nearer said back edge than said front edge, wherein said supports have a height such that said drawer assembly is displaced away from a ground surface when said panel is supported by said front edge and said supports; and a light emitting device being mounted on said panel, said light emitting device being adapted for selectively directing light emitted from said light emitting device, said light emitting device including a base, a neck and a head portion, said base being attached to said back edge, said neck being attached to and extending upwardly from said base, said neck being selectively bendable, said head portion being attached to an upper end of said neck, said head portion being adapted for receiving a light bulb.

* * * * *